US006170273B1

(12) United States Patent
Bosi

(10) Patent No.: US 6,170,273 B1
(45) Date of Patent: Jan. 9, 2001

(54) INTERACTIVE DISPLAY UNIT FOR REFRIGERATED FOODS

(75) Inventor: Stefano Bosi, San Pancrazio Parmense (IT)

(73) Assignee: Nestec S.A., Vevey (CH)

( * ) Notice: Under 35 U.S.C. 154(b), the term of this patent shall be extended for 0 days.

(21) Appl. No.: 09/125,925

(22) PCT Filed: Mar. 4, 1997

(86) PCT No.: PCT/EP97/01074

§ 371 Date: Aug. 31, 1998

§ 102(e) Date: Aug. 31, 1998

(87) PCT Pub. No.: WO97/33269

PCT Pub. Date: Sep. 12, 1997

(30) Foreign Application Priority Data

Mar. 8, 1996 (IT) ..... TO960046 U

(51) Int. Cl.[7] ..... F25B 49/02

(52) U.S. Cl. ..... 62/127; 345/962; 340/547

(58) Field of Search ..... 700/83; 62/259.3, 62/126, 246, 531, 127; 312/116; 362/92; 345/962; 340/547

(56) References Cited

U.S. PATENT DOCUMENTS

| | | | | |
|---|---|---|---|---|
| 3,759,059 | * | 9/1973 | Kenyon | 62/246 |
| 4,274,267 | | 6/1981 | James et al. | 62/252 |
| 4,359,631 | | 11/1982 | Lockwood et al. | 235/381 |
| 4,414,768 | | 11/1983 | Bachmann et al. | 40/584 |
| 4,449,761 | * | 5/1984 | Davis | 312/116 |
| 4,454,670 | * | 6/1984 | Bachmann | 40/584 |
| 4,551,935 | | 11/1985 | Bachmann et al. | 40/584 |
| 4,602,827 | * | 7/1986 | Cassanova | 62/246 |
| 4,646,528 | * | 3/1987 | Marcade | 324/303 |
| 5,117,407 | | 5/1992 | Vogel | 369/30 |
| 5,159,560 | * | 10/1992 | Newell et al. | 364/479 |
| 5,593,017 | * | 1/1997 | Powell | 194/212 |
| 5,839,112 | * | 11/1998 | Screitmueller | 345/326 |

FOREIGN PATENT DOCUMENTS

| | | |
|---|---|---|
| 2 289 971 | 12/1995 | (GB) . |
| WO 89/07807 | 8/1989 | (WO) . |

* cited by examiner

*Primary Examiner*—Raymond J. Bayerl
*Assistant Examiner*—Thomas Joseph
(74) *Attorney, Agent, or Firm*—Pennie & Edmonds LLP

(57) ABSTRACT

The invention relates to a display unit for the distribution of products, in particular a refrigerated display unit for food products such as ice cream and the like, which includes a cabinet in the form of a chest defining an environment for containing the products and having a top opening for access. The display unit includes an electric or electronic display panel arranged near the opening in the cabinet and operable to generate a plurality of predetermined visual presentations, and control means which the user can manipulate to cause a predetermined visual presentation to be generated on the display panel.

15 Claims, 5 Drawing Sheets

INTERACTIVE DISPLAY UNIT FOR REFRIGERATED FOODS

TECHNICAL FIELD

The present invention relates to a display unit for the distribution of products, in particular to a refrigerated display unit for food products such as ice cream and the like.

More specifically, the subject of the invention is a display unit which comprises a cabinet in the form of a chest defining an environment intended to contain the products and having an access aperture at the top.

Cabinets of the above type are widely used for the distribution of products, in particular ice cream and the like, for example in supermarkets and other points of distribution/sale such as cafes and other commercial premises.

Prior art cabinets are essentially containers for conserving the products which, in use, are either removed directly by the customer or by a sales or distribution assistant.

In the case of products such as ice cream and the like, the climate in such cabinets is regulated by thermostat-controlled refrigeration systems of a type known per se.

Until now, the design of such cabinets has generally been aimed at merely fulfilling the essential functional requirement of containing the products, and possibly keeping them at a given temperature, and enabling them to be removed more or less easily.

In a few cases, while fulfilling the basic functional requirements, attention has been given to the aesthetics of the design, so as to give the cabinet a more attractive and pleasing appearance.

The functional characteristics of such units have, however, remained essentially unchanged.

With the above in mind, a main object of the present invention is to provide a display unit of the type described above which, in addition to fulfilling the aforesaid essential functional requirements, encourages interaction with the customer, thereby making it generally more "appealing" and thus more likely to promote the purchase of the products.

This and other objects are achieved according to the invention by providing a unit for the distribution of products having a cabinet which defines an environment for containing the products and which has a top access opening. This unit includes an electric or electronic display panel arranged near the top access opening and operable to generate a plurality of predetermined visual displays. A control means operable by a user, generates these visual displays on the display panel, which also presents static images of the products contained in the unit along with associated luminous devices that can be selectively activated by commands from a user in operating the control means. This display unit is particularly useful for refrigerated products such as ice cream and the like.

Further characteristics and advantages of the invention will become apparent from the detailed description which follows, provided purely by way of non-limitative example, with reference to the appended drawings, in which:

BRIEF DESCRIPTION OF THE DRAWINGS

In FIG. 1, a display unit for the distribution of products, in particular a refrigerated unit for ice cream and the like, is generally indicated 1.

Figure 2:
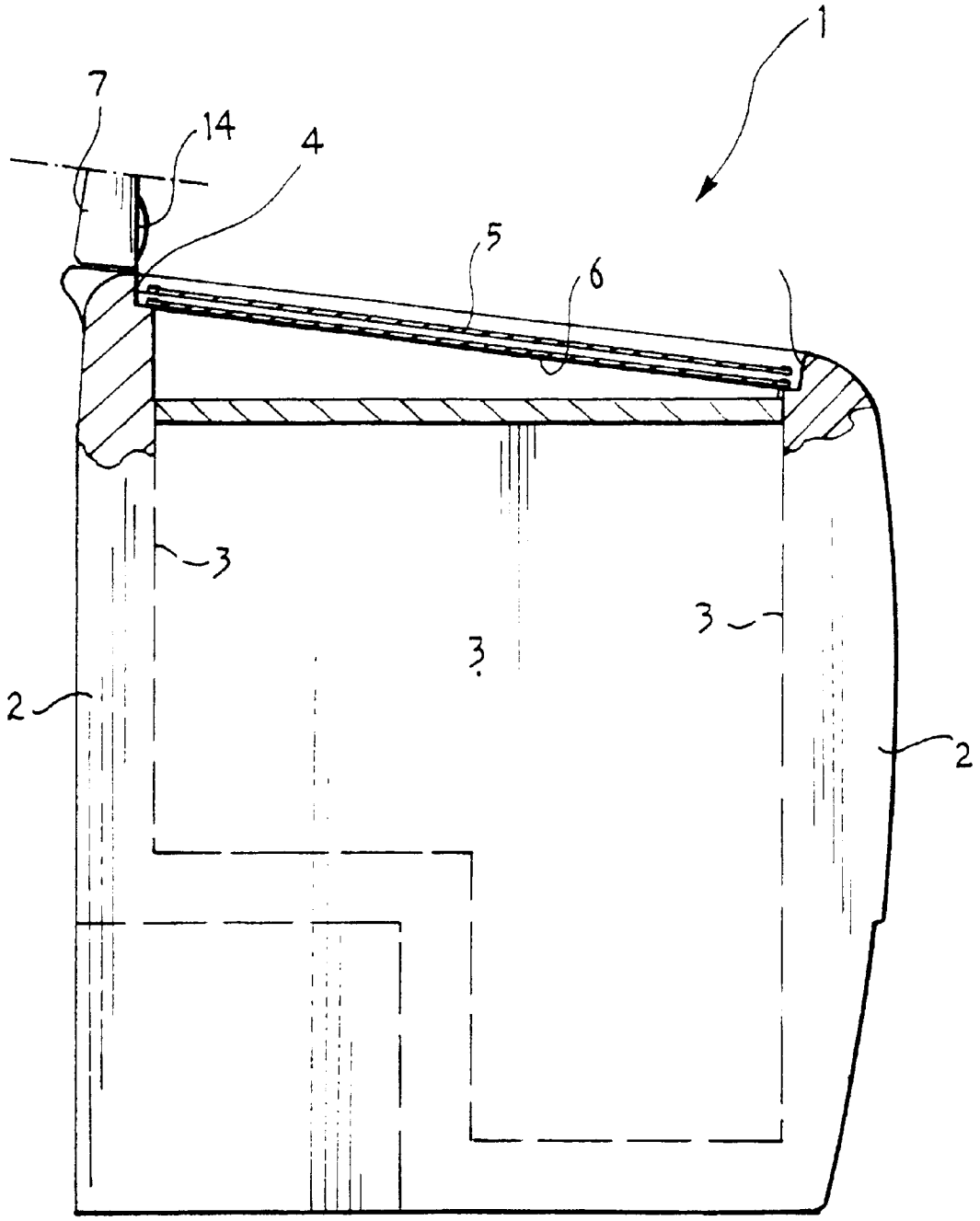
FIG. 2 is a partially sectioned view taken on the line II—II of FIG. 1.

This unit comprises a container 2 in the form of a cabinet, defining therein an environment 3 (FIG. 2) intended to contain the products (not shown). At the top, the container 2 has an opening 4 giving access to the environment 3.

DETAILED DESCRIPTION OF THE PREFERRED EMBODIMENT

In the embodiment illustrated by way of example, two lids 5 and 6 are associated with this opening 4, constituted essentially by two sheets of transparent material, slidable in respective, parallel planes. Each of these lids extends for about half the extent of the opening 4 of the cabinet 2.

Other lid arrangements or equivalent closure elements are of course possible.

The display unit 1 shown in the drawings also includes an electric or electronic display panel, generally indicated 7. This panel is arranged along one side of the top opening 4 of the cabinet 2 and may, in particular, be hinged or otherwise pivoted on this side of the aperture 4, as shown in FIG. 4.

As will be explained better later, the display panel 7 is generally designed to offer a plurality of predetermined visual presentations.

Figure 1:
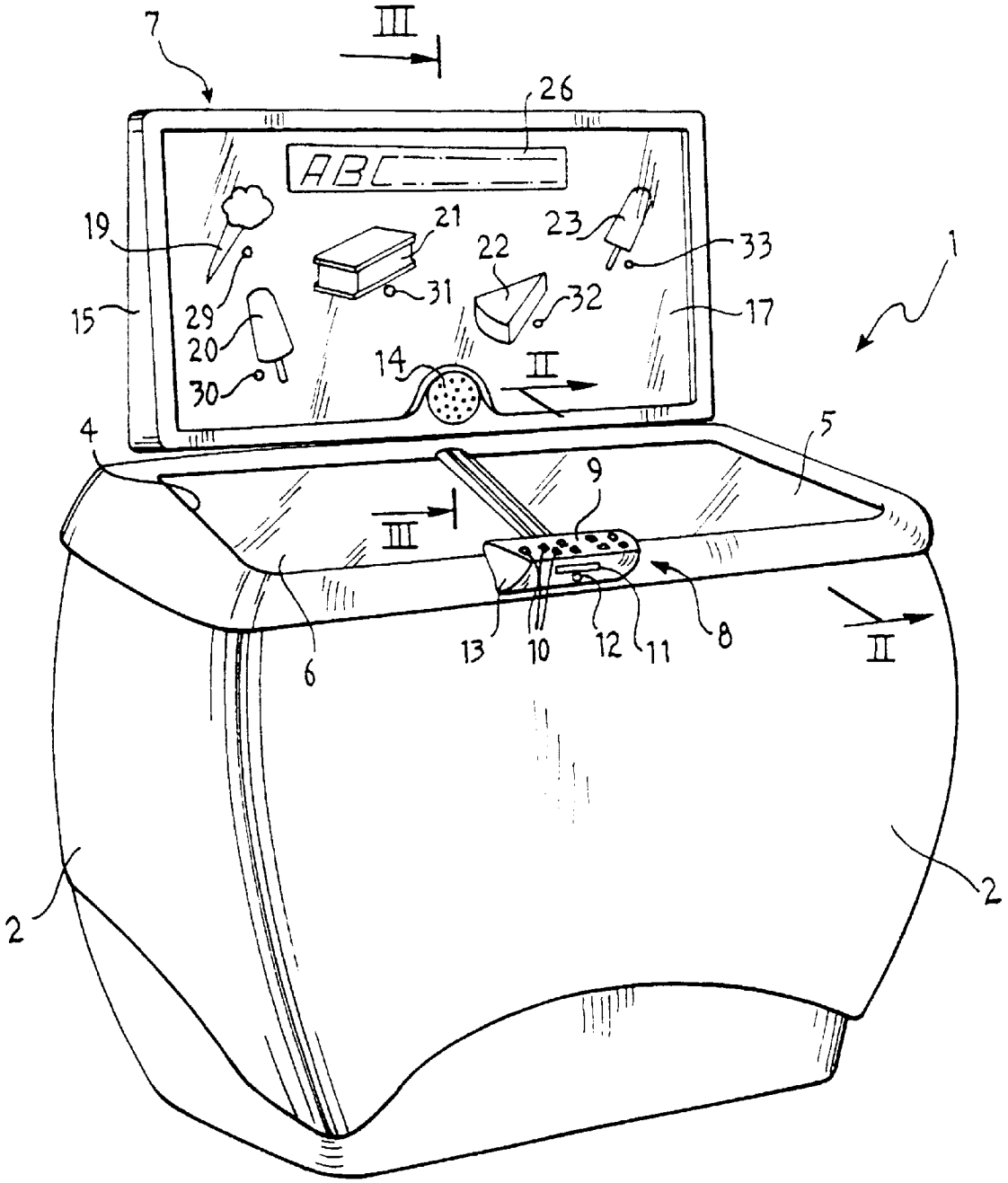
FIG. 1 is a perspective view of an example of an embodiment of a unit according to the invention.
Figure 4:
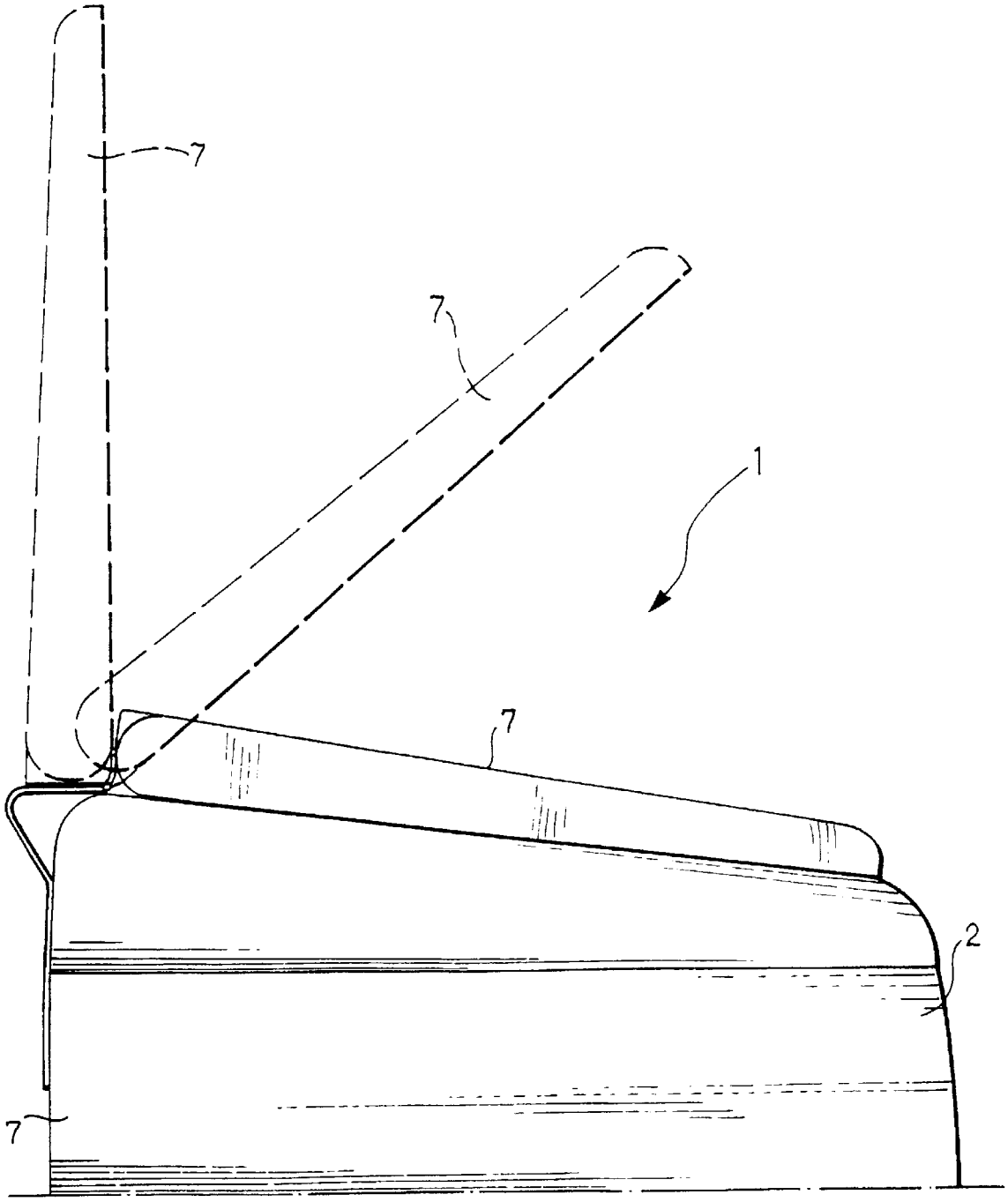
FIG. 4 is a partial side view of a unit according to the invention, showing various possible positions of the display panel.

For preference, though not necessarily, the display panel 7 has essentially the same dimensions as the top opening 4 of the cabinet 2 and may be arranged in a raised, presentation position, shown in FIG. 1, or in a reclining or lowered position in which is acts as an additional lid closing the said opening 4, as illustrated in FIG. 4.

Figure 5:
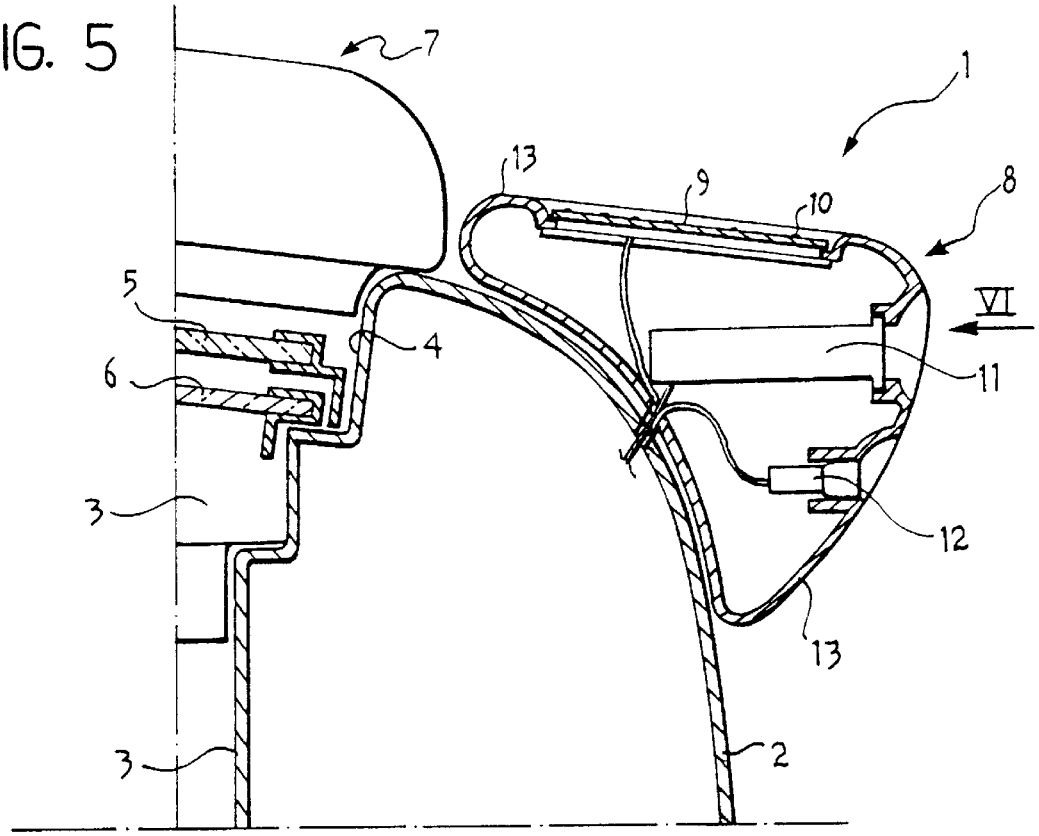
FIG. 5 is a partially sectioned side view showing a detail of a unit according to the invention.
Figure 6:
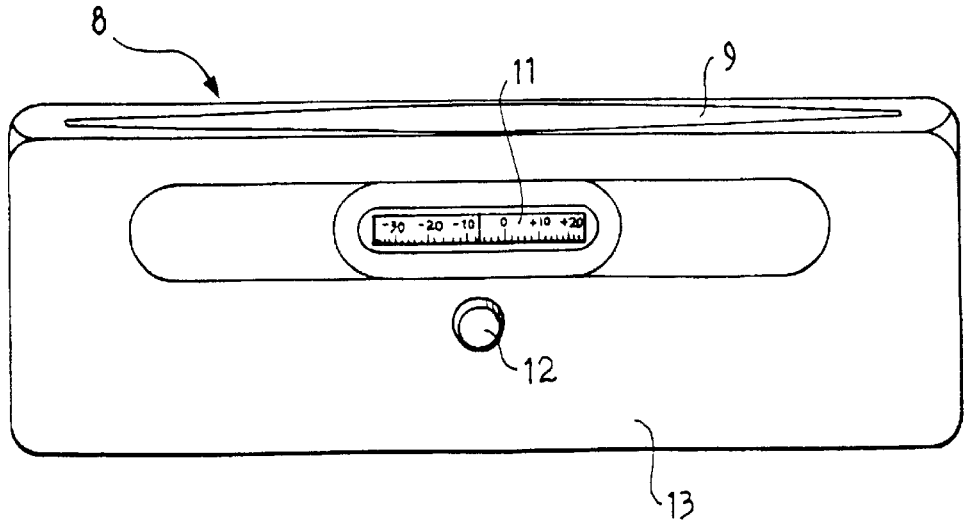
FIG. 6 is a partial front view of the detail indicated VI in FIG. 5.

The unit 1 also includes a control panel which in the embodiments illustrated by way of example in FIGS. 1, 5 and 6 is generally indicated 8. This panel can include a control keypad 9, for example of a sensitive membrane type. Light-emitting diodes or similar luminous devices may conveniently be associated with the keypad (see FIG. 7).

The unit 1 can also include a temperature indicator, such as that indicated 11 in FIGS. 5 and 6, connected to a thermometer arranged in the environment 3 to indicate the temperature inside the cabinet.

Figure 7:
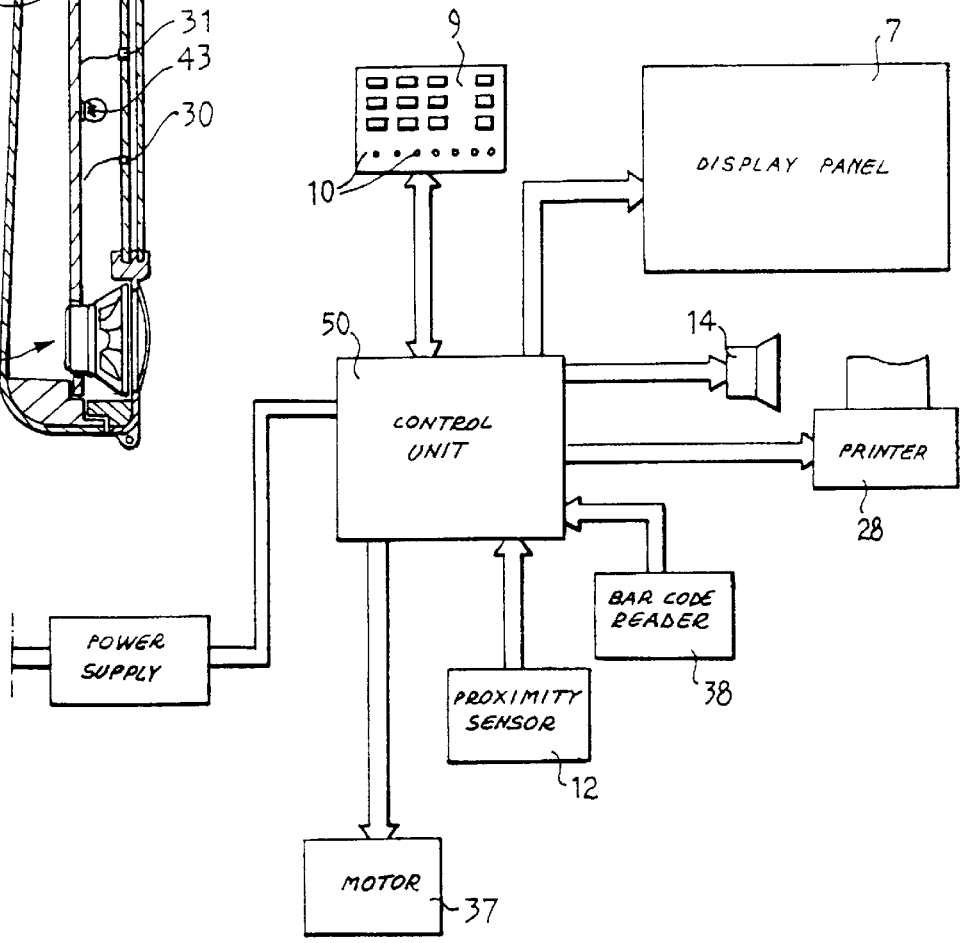
FIG. 7 is a block diagram of the electric/electronic components of a cabinet according to the present invention.

The unit 1 may also include a proximity sensor, such as that indicated 12 in FIG. 1 and in FIGS. 5–7, operable to detect the presence or the passage of a person in the vicinity of the unit and to emit a corresponding signal.

For convenience, though not necessarily, as shown in FIGS. 5 and 6, the keypad 9, the temperature indicator 11 and the proximity sensor 12 may be mounted in a common casing (indicated 13 in the said drawings) fixed to the front portion of the rim of the cabinet 2, as shown in particular in FIGS. 1 and 5.

The unit 1 may conveniently be equipped with at least one electro-acoustic transducer, such as a loudspeaker or the like, for the generation of acoustic signals and/or sound and/or vocal messages. In the embodiment illustrated by way of example, the unit 1 includes a loudspeaker 14 arranged in the lower portion of the display panel 7 (see FIGS. 1, 2 and 3).

Figure 3:
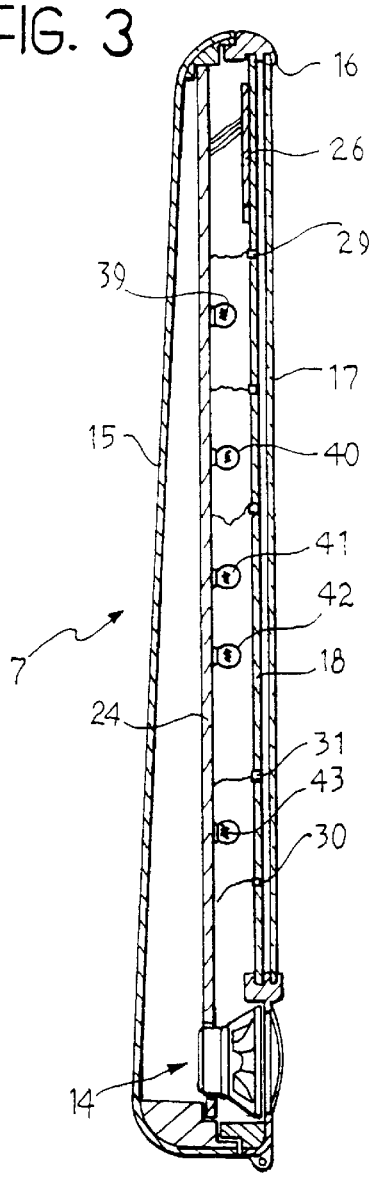
FIG. 3 is a section taken on the line III—III of FIG. 1 and shows an example of the structure of a display panel forming part of a unit according to the invention.

The display panel 7 may be constructed, for example, as described hereafter, with particular reference to FIGS. 1 and 3.

In this embodiment, the panel 7 includes a casing or shell 15, of plastics material or sheet metal for example, with a front opening 16 in which is mounted a plate 17 of transparent material such as polycarbonate, A second plate 18, also made, for example of polycarbonate, is arranged inside the shell 15, behind the protective plate 17. The plate 18 carries a plurality of iconographic images of the products contained in the unit 1, similar, for example, to the images indicated 18 to 23 in FIG. 1. These images or illustrations may be applied to the plate 18 by screen printing for example. The plate 18 has corresponding light-emitting diodes, indicated 29–33 in FIG. 1, next to the images 19–23 of the products.

An additional plate or sheet 24 of plastics material can also be arranged inside the shell 15, carrying a plurality of light bulbs or the like, indicated 39–43 in FIG. 3, each of which is arranged in correspondence with a respective product image 19–33.

The plate 18 may also carry at least one display device of an alphanumeric type 26 (see FIGS. 1 and 3), for displaying messages to the users or customers.

The various electrical/electronic devices included in the display panel 7 are connected to a control unit, indicated 50 in FIG. 7, arranged in a special housing (not shown) preferably positioned in the rear portion of the cabinet 2.

The control panel 8 and the keypad 9, the light-emitting diodes and the proximity sensor 12, as well as the loudspeaker 14, are also connected to the unit 50.

With a display unit 1 according to the invention, equipped with the control keypad 9 the user or client can operate the buttons of the keypad in order to choose from the categories of products contained in the unit and shown on the display panel. In this event, the control unit 50 is pre-set to control the selective activation of the bulbs and the light-emitting diodes on the panel 7 which correspond to the category of products selected. In addition to this visual presentation of the selected products, in accordance with the command given by the customer using the keypad 9, the control unit 50 can cause the loudspeaker 14 to give out predetermined acoustic signals or sound and/or vocal messages.

If light emitting diodes 10 are connected to the keypad 9, the control unit 50 may be regulated so as to activate them according to predetermined instructions, either in a stand-by condition, that is when there are no users near the unit 1, or upon a command given by means of the keypad 9. In the same way, the control unit 50 can be regulated so as to activate the light bulbs and the diodes on the panel 7 according to instructions which could be different, for example, for a stand-by condition and for responding to a command on the keypad from a user.

If the display panel 7 includes an alphanumeric display, the control unit 50 can be regulated so as to generate messages to "attract" customers in stand-by conditions and to issue predetermined messages in response to commands given by a user by means of the keypad 9.

The display panel could also be activated and/or acoustic signals or sound and/or vocal messages could be generated on detection by the proximity sensor 12 of the presence or passage of a user near the unit 1, instead of by a command on the keypad 9.

A unit according to the invention can also be manufactured without the keypad 9 and the associated light-emitting diodes but with only a proximity sensor to activate the display panel and/or emit acoustic signals or sound and/or vocal messages.

The display panel 7 may be made differently from the one described above with reference to FIGS. 1 and 3. In particular, this panel may be constituted by a video terminal of the type used, for example, for personal computers, for showing static and/or dynamic images. In this event, the electronic control unit 50 may be set up so as to control an interactive video game or the like, in which a customer can intervene by operating one or more push-buttons arranged for this purpose in the keypad 9 of the control panel.

The control unit 50 could also be equipped with a memory device in order to retain data or signals which could be used to reproduce musical tunes which could be selected by the customer by means of the keypad 9 of the control panel.

These tunes could then be reproduced by means of the electroacoustic transducer, or transducers, arranged in the display unit, such as the loudspeaker 14 described earlier.

A display unit according to the invention may also be set up so as to operate a pseudo-random sequence and give a user a free product.

This can be achieved, for example, by means of a device, incorporated in the control unit 5, which generates a pseudo-random sequence of signals, and operable to emit a corresponding message, which may be visual, for example by means of the display panel 7, or acoustic or vocal by means of the loudspeaker 14.

Alternatively, the device for generating pseudo-random signals may be set up so as to print, in a pseudo-random sequence, a message offering a free product by means of a printer (indicated 28 in FIG. 7) associated with the unit 1.

According to a further variant, the keypad 9 of the control panel of the display unit 1 may be used by the customer to transmit a code and the control unit 50 may include a generator of pseudo-random signals, set up to generate a randomly variable code each time a customer punches out a code, and a comparator for comparing the code punched out by the customer with that generated by the generator. Should the two coincide, the control unit 50 would control the emission of a visual, acoustic or vocal image announcing that a free product has been won.

Instead of the keypad 9, the user could use a bar-code reading device to enter a code, such as that indicated by block 38 in FIG. 7, connected or otherwise associated with the display unit 1 and operable to read a code which would be carried by a support such as a card or a ticket which would, for example, be given to the user at the entrance to the commercial premises housing the display unit.

A display unit according to the invention may also have an electric motor (such as that indicated 37 in FIG. 7) for controlling, by appropriate transmission means, the opening and closing of the lids 5, 6 associated with the cabinet 2. For convenience, this motor is controlled by the control unit 50 and a user may turn it on by means of the keypad 9 of the control panel of the display unit.

Naturally, the principles of the invention remaining unchanged, the embodiments and manufacturing details thereof may vary widely from those described and illustrated purely by way of non-limitative example, the invention extending to all realisations which achieve the same utility by the same inventive concept as defined in the annexed Claims.

What is claimed is:

1. A display unit for the distribution of food products comprising:

a cabinet defining an environment for containing the products and having a top access opening, a display panel arranged near the opening of the cabinet and operable to generate a plurality of predetermined visual displays, control means operable by a user in order to generate a predetermined visual display on the display panel, associated luminous devices, and at least one movable lid associated with the top opening of the cabinet, wherein the display panel includes a display area showing static images of the products contained in the unit, the associated luminous devices are activated selectively by said control means, and the position of the lid is controllable by a motor activatable by the control means.

2. A display unit according to claim 1, further comprising:

a device for generating signals announcing an offer of a free product to the user.

3. A display unit according to claim 2, wherein the device for generating signals is pre-set to generate a visual display, sound, or vocal message announcing the offer of the free product.

4. A display unit according to claim 2, wherein the device for generating signals is connected to a printer associated with the unit and is set to print a message offering the free product.

5. A display unit according to claim 4, which further includes a control panel for enabling the user to introduce a control panel code, and wherein the signal generator is set to give out a variable generator code each time the user introduces the control panel code by means of the control panel, and a comparator is provided for comparing the control panel code introduced by the user with the generator code and for emitting signals announcing the offer of the free product to the user should the control panel code and the generator code coincide.

6. A display unit according to claim 5, wherein the control panel includes a keypad.

7. A display unit according to claim 5, wherein the device for introducing the control panel code includes a bar code reader.

8. A display unit according to claim 1 which further includes memory means for storing signals or data for reproduction of tunes which the user can choose by means of the control means.

9. A display unit according to claim 1 wherein the control means include a control panel with a plurality of control devices which are selectively operable by the user so as to determine, according to a command given, the generation on the display panel of a corresponding predetermined visual display.

10. A display unit according to claim 9, which further includes at least one device which can be activated to generate acoustic signals or sound or vocal messages.

11. A display unit according to claim 10, wherein the acoustic signal or message generator is connected to the control means and is set as to generate corresponding predetermined acoustic signals or sound or vocal messages according to the command given by the user by means of the control panel.

12. A display unit according to claim 1, which further includes at least one sensor device operable to detect a presence or a passage of a person near the display unit and to emit a corresponding signal activating the control means associated with the display panel or with the acoustic signal or sound or vocal message generator.

13. A display unit according to claim 10, wherein the device for generating acoustic signals or sound or vocal messages includes at least one electroacoustic transducer, arranged in the display panel.

14. A display unit according to claim 10, wherein the display panel is pivoted onto one side of the opening in the cabinet and can be arranged in a raised presentation position and in a lowered position in which it acts as a lid for the opening.

15. A display unit according to claim 1, characterized in that it includes a plurality of light bulbs each being arranged in a correspondence with a respective static image of the product and with a respective associated luminous device.

* * * * *

UNITED STATES PATENT AND TRADEMARK OFFICE

CERTIFICATE OF CORRECTION

PATENT NO. : 6,170,273 B1
DATED : January 9, 2001
INVENTOR(S) : Stefano Bosi

It is certified that error appears in the above-identified patent and that said Letters Patent is hereby corrected as shown below:

Column 6,
Line 19 (claim 11, line 3) after "set" insert -- so --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*